US008679424B2

(12) United States Patent
Koeda

(10) Patent No.: US 8,679,424 B2
(45) Date of Patent: Mar. 25, 2014

(54) BIOTIP

(75) Inventor: Hiroshi Koeda, Suwa (JP)

(73) Assignee: Seiko Epson Corporation (JP)

( * ) Notice: Subject to any disclaimer, the term of this patent is extended or adjusted under 35 U.S.C. 154(b) by 55 days.

(21) Appl. No.: 13/324,102

(22) Filed: Dec. 13, 2011

(65) Prior Publication Data

US 2012/0145260 A1 Jun. 14, 2012

(30) Foreign Application Priority Data

Dec. 14, 2010 (JP) ..... 2010-277759

(51) Int. Cl.
*F15D 1/00* (2006.01)

(52) U.S. Cl.
USPC ..... 422/527; 422/533; 422/547; 422/548; 422/549; 422/550; 422/556; 422/558; 422/560; 422/561; 422/565; 422/566; 436/45; 436/180; 435/288.1; 435/6.12; 435/303.1; 435/304.1

(58) Field of Classification Search
USPC ..... 422/527, 533, 547–550, 556, 558, 560, 422/561, 565, 566; 436/180, 45; 435/288.1, 435/6.12, 303.1, 304.1
See application file for complete search history.

(56) References Cited

U.S. PATENT DOCUMENTS 5,252,250 A * 10/1993 Endo et al. ..... 252/73

FOREIGN PATENT DOCUMENTS

JP 2009-136250 6/2009

* cited by examiner

*Primary Examiner* — Brian R Gordon
*Assistant Examiner* — Shogo Sasaki
(74) *Attorney, Agent, or Firm* — Harness, Dickey & Pierce, P.L.C.

(57) ABSTRACT

A biotip according to an embodiment of the invention moves a reaction mixture along a longitudinal direction under the force of gravity. The biotip includes a chamber formed of a transparent material and filled with a liquid having a smaller specific gravity than the reaction mixture and immiscible with the reaction mixture, and a seal that seals the chamber. The liquid has a volume resistivity of greater than 0 Ω·cm and $5\times10^{13}$ Ω·cm or less.

5 Claims, 5 Drawing Sheets

BIOTIP

CROSS-REFERENCE

This application claims priority to Japanese Patent Application No. 2010-277759, filed Dec. 14, 2010, the entirety of which is hereby incorporated by reference.

BACKGROUND

1. Technical Field

The present invention relates to biotips.

2. Related Art

Along with the recent development of the techniques that make use of genes, there is growing interest in remedies that use genes, such as in gene diagnosis and gene therapy. Many techniques that use genes for variety discrimination and breeding also have been developed in the field of agriculture and livestock. One widely used technique that makes use of genes is the nucleic acid amplification technique, as represented by PCR (Polymerase Chain Reaction). PCR has become a technique indispensable for understanding the information of biological substances.

PCR generally uses a technique in which a biochemical reaction chamber called a tube or a tip (hereinafter, "biotip") is used to perform the reaction. However, the techniques of related art are problematic, because the reaction uses large amounts of reagents and other materials, and complex apparatuses to realize the thermal cycle necessary for the reaction. Another problem is that the reaction is time consuming. Accordingly, a biotip or a reactor capable of accurately performing PCR in a short time period using minute amounts of reagents and specimens is needed.

As a countermeasure against these problems, JP-A-2009-136250 discloses a biotip and an apparatus used to perform a thermal cycle reaction by the reciprocal movement of a reaction mixture droplet in a tube filled with a liquid (such as a mineral oil) immiscible with the reaction mixture and having a different specific gravity from that of the reaction mixture.

However, when the biotip disclosed in JP-A-2009-136250 is used for applications where the amplification product is detected by fluorescence measurement performed outside of the chamber, the chamber needs to be made of a transparent material. Resin and heat-resistance glass are among the examples of the transparent material. These materials, however, are easily charged under the influence of, for example, friction. Such charging can be suppressed by subjecting the inner surface of the chamber to a hydrophilic treatment. However, because the reaction mixture is an aqueous solution and adheres to the chamber, the movement of the reaction mixture is impeded. This has made it difficult to employ the hydrophilic treatment for the biotip.

Considering stability against heat and the reaction mixture, a silicone oil or a mineral oil can be used as the liquid immiscible with the reaction mixture and having a different specific gravity from that of the reaction mixture. However, because these oils are generally insulants, the reaction mixture droplet introduced into the oil easily polarizes. For this reason, introducing the reaction mixture into a transparent chamber filled with the oil generates an electric field between the reaction mixture and the chamber. The electric field may cause the reaction mixture to be attracted and adhere to the inner wall of the chamber, or suspended in the oil by repulsion. If PCR is performed under such conditions using a method that moves the reaction mixture in the biotip under the force of gravity (hereinafter, this method will be referred to as "droplet-shuttle" method), the reaction mixture may not move appropriately, and thermal cycling may not be performed desirably.

SUMMARY

An advantage of some aspects of the invention is to provide a biotip that can overcome the charge generated in the biotip, and that can be used to stably perform thermal cycling for the reaction mixture.

APPLICATION EXAMPLE 1

This Application Example is directed to a biotip that moves a reaction mixture along a longitudinal direction under the force of gravity. The biotip includes a chamber formed of a transparent material and filled with a liquid having a different specific gravity from that of the reaction mixture and immiscible with the reaction mixture, and a seal that seals the chamber. The liquid has a volume resistivity of greater than 0 $\Omega\cdot$cm and $5\times10^{13}$ $\Omega\cdot$cm or less.

The present inventors conducted intensive studies, and found that the biotip of this Application Example could overcome the uneven electrical charge in the chamber or reaction mixture by spreading the charge over the liquid having a different specific gravity from that of the reaction mixture and immiscible with the reaction mixture, when the liquid has a volume resistivity of $5\times10^{13}$ $\Omega\cdot$cm or less. Thus, the reaction mixture dispensed into the chamber and sealed with the seal can move easily, and can be subjected to stable thermal cycling in the biotip.

APPLICATION EXAMPLE 2

The liquid filled in the biotip of the foregoing Application Example may include a first liquid having a different specific gravity from that of the reaction mixture, and a second liquid having a different specific gravity from that of the reaction mixture and a smaller volume resistivity than the first liquid.

The biotip according to this Application Example includes a first liquid, and a second liquid having a smaller volume resistivity than the first liquid. The volume resistivity of the liquid can thus be adjusted by adjusting the proportion of the second liquid in the liquid. Because this enables a liquid of large volume resistivity to be selected as the first liquid, the liquid can be adjusted to have properties more suited for PCR.

APPLICATION EXAMPLE 3

The biotip of the foregoing Application Example may use a silicone oil or a mineral oil as the first liquid.

Because the biotip according to this Application Example includes a silicone oil or a mineral oil as the first liquid, the liquid can be adjusted to have properties more suited for PCR.

APPLICATION EXAMPLE 4

The biotip according to the foregoing Application Example may use a modified silicone oil as the second liquid.

Because the biotip according to this Application Example includes a modified silicone oil as the second liquid, it is possible to adjust the conductivity of the liquid.

APPLICATION EXAMPLE 5

This Application Example is directed to a biotip that moves a reaction mixture along a longitudinal direction under the force of gravity. The biotip may include two or more chambers formed of a transparent material and filled with a liquid having a different specific gravity from that of the reaction mixture and immiscible with the reaction mixture, a seal that seals each of the two or more chambers, and a substrate that holds the two or more chambers within a single flat plane. The liquid may have a volume resistivity of greater than 0 Ω·cm and $5\times10^{13}$ Ω·cm or less. The radial direction from the center at a given point on the flat plane may coincide with the longitudinal direction of the chambers.

The biotip according to this Application Example includes two or more chambers that are held in such a way that the radial direction from the center at a given point on a single flat plane coincides with the longitudinal direction of the chambers. Thus, in a reaction performed with the biotip of this Application Example installed in a droplet-shuttle PCR apparatus, rotating the substrate about this point enables the plurality of chambers to be uniformly subjected to thermal cycling in the biotip.

BRIEF DESCRIPTION OF THE DRAWINGS

The invention will be described with reference to the accompanying drawings, wherein like numbers reference like elements.

FIGS. 4A and 4B are diagrams schematically illustrating a biotip according to Second Embodiment, in which FIG. 4A is a plan view, and FIG. 4B is a schematic cross sectional view taken at line A-A of FIG. 4A.

DESCRIPTION OF EXEMPLARY EMBODIMENTS

The following describes a preferred embodiment of the invention with reference to the accompanying drawings, in the order below. It should be noted that the embodiment described below does not unduly restrict the contents of the invention recited in the claims. Note also that the configurations described below do not necessarily represent the necessary constituting elements of the invention.

Figure 1:
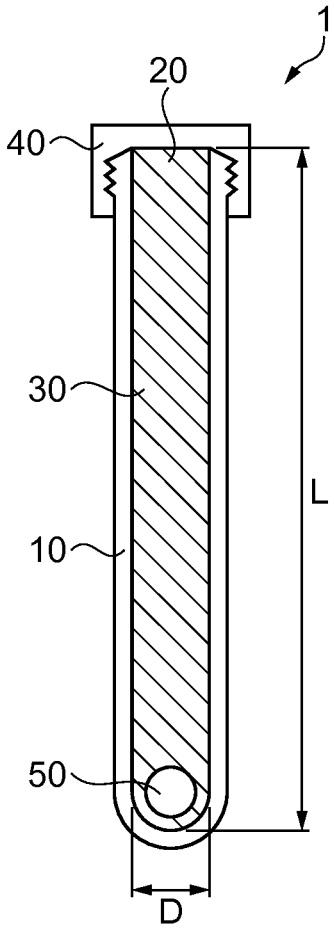
FIG. 1 is across sectional view of a biotip according to First Embodiment.

1. First Embodiment
1-1. Configuration of Biotip According to First Embodiment
1-2. Thermal Cycling Process Using Biotip of First Embodiment
2. Second Embodiment
2-1. Configuration of Biotip According to Second Embodiment
2-2. Thermal Cycling Process Using Biotip of Second Embodiment
3. Example
4. Variation 1. First Embodiment 1-1. Configuration of Biotip According to First Embodiment FIG. 1 is a cross sectional view of a biotip (biological sample reaction chamber) 1 according to First Embodiment. FIG. 1 represents the state in which a reaction mixture is introduced in the biotip.

A biotip 1 according to First Embodiment is configured to include a chamber main body 10 (hereinafter, "chamber 10") and a seal 40. The size and shape of the biotip 1 are not particularly limited. For example, the biotip 1 may be designed by taking into account at least one of the following: the amount of a liquid immiscible with a reaction mixture 50 and having a different specific gravity from that of the reaction mixture 50 (hereinafter, "liquid") 30, heat conductivity, the shapes of the chamber 10 and the seal 40, and ease of handling.

The chamber 10 of the biotip 1 may be formed of a transparent material. With the chamber 10 formed of a transparent material, the biotip 1 can be used in applications, for example, where the movement of the reaction mixture 50 in the chamber 10 is observed from outside of the biotip 1, and where measurements are made outside of the chamber 10, such as in real-time PCR. Note that, as used herein, "transparent" means an extent of visibility that allows the reaction mixture 50 inside the chamber 10 to be observed from outside of the chamber 10, and it is not necessarily required that the whole part of the biotip 1 be transparent, as long as this condition is satisfied.

When the biotip 1 is used for applications that involve fluorescence measurement, for example, such as in real-time PCR, it is preferable that the chamber 10 be formed using a material with small spontaneous fluorescence. The chamber 10 is preferably made of a material that can withstand the heat of PCR. Further, the material of the chamber 10 is preferably a material that adsorbs only limited amounts of nucleic acid and protein, and that does not inhibit enzyme reactions such as polymerase reaction. Examples of materials that satisfy these conditions include polypropylene, cycloolefin polymers (for example, ZEONEX® 480R), and heat-resistant glass (for example, PYREX® glass). These may be used as a composite material. However, for example, polypropylene is preferred in terms of cost, and ease of handling.

In the biotip 1 illustrated in FIG. 1, the chamber 10 is cylindrical in shape with the central axis direction (vertical direction in FIG. 1) representing the longitudinal direction.

Because the chamber 10 has a longitudinal direction (a long narrow shape), the distance between the regions of different temperatures can be easily increased when, for example, the temperature in the biotip 1 is controlled with a droplet-shuttle thermal cycler (described later) so as to form regions of different temperatures in the liquid 30 inside the chamber 10. This makes it easier to control the temperature of the liquid 30 in each region of the chamber 10, and thermal cycling suited for PCR can be realized. Note that the droplet-shuttle thermal cycler is a device that controls temperature to create at least two temperature regions in the chamber 10, and moves the reaction mixture 50 back and forth between these temperature regions for thermal cycling.

Further, the long narrow shape of the chamber 10 increases the proportion of the surface area of the chamber 10 with respect to the volume of the chamber 10. This improves the heat conduction efficiency, and makes the temperature adjustment of the liquid 30 easier.

The shape of the chamber 10 is not particularly limited, as long as it has a longitudinal direction. For use in droplet-shuttle PCR, the chamber 10 preferably has a substantially cylindrical shape with the ratio of inner diameter D to longitudinal direction length L ranging from 1:5 to 1.5:20. It is more preferable that the inner diameter D be 1.5 to 2 mm, and that the length L be 10 to 20 mm. With this shape, the convection of the liquid 30 in the chamber 10 can be suppressed in the presence of applied heat to the liquid 30 inside the chamber 10. This stabilizes the temperature gradient of the liquid 30, and can thus realize appropriate thermal cycling for the reaction mixture 50.

The chamber 10 is configured in a manner allowing the reaction mixture 50 to be introduced through an inlet 20. The reaction mixture 50 is a liquid that contains a specimen, possibly with the target DNA (nucleic acid targeted for amplification). Examples of the target DNA include DNAs prepared from specimens such as blood, urine, saliva, and spinal fluid, and cDNAs reverse-transcribed from the RNAs prepared from the specimen. The reaction mixture 50 may include primers for amplifying the target DNA, PCR master mix (containing, for example, a polymerase, nucleotides, $MgCl_2$, etc.), and fluorescent probes for detecting the target DNA amplification product.

Note that at least one of the primer and the fluorescent probe may be applied inside the chamber 10 of the biotip 1 in necessary amounts. In this way, dispensing the specimen preparation and PCR master mix into the biotip 1 through the inlet 20 enables the specimen preparation to mix with at least one of the primer and the fluorescent probe. This makes the PCR easier.

The chamber 10 is filled with the liquid 30. Preferably, the liquid 30 is filled in the chamber 10 in an amount that does not leave any air inside the chamber 10 upon sealing the chamber 10 with the seal 40 (described later) after the reaction mixture 50 is dispensed into the chamber 10. In this way, the remaining bubbles in the chamber 10 do not impede the movement of the reaction mixture 50, and a stable thermal cycle can be realized.

The liquid 30 has a smaller specific gravity than the reaction mixture 50 introduced into the biotip 1, and is immiscible with the reaction mixture 50. The liquid 30 has a volume resistivity of greater than 0 Ω·cm and $5\times10^{13}$ Ω·cm or less. As used herein, "volume resistivity" means the electrical resistivity of the material (liquid 30 in this embodiment), and is also called a specific volume resistivity.

Because the liquid 30 is immiscible with the reaction mixture 50, the reaction mixture 50 undergoes liquid-liquid phase separation from the liquid 30 upon being introduced into the chamber 10. The reaction mixture 50 can thus form a droplet in the liquid 30. Further, because the liquid 30 has a smaller specific gravity than the reaction mixture 50, the reaction mixture 50 as the droplet having a greater specific gravity than the liquid 30 moves in the direction of the gravitational force under the force of gravity upon being introduced into the chamber 10.

The liquid 30 may have a greater specific gravity than the reaction mixture 50. In this case, because the droplet of the reaction mixture 50 has a smaller specific gravity than the liquid 30, the reaction mixture 50 under the force of gravity can move in the liquid 30 in the opposite direction from the direction of the gravitational force.

With the liquid 30 having a volume resistivity of $5\times10^{13}$ Ω·cm or less, the electrical charge of the chamber 10 can be spread in the liquid 30, and the polarization of the reaction mixture 50 can be suppressed. This makes it possible to overcome the unevenness in the electrical charge of the chamber 10 and the reaction mixture 50. Thus, the local unevenness in the electrical charge density of the chamber 10 or the reaction mixture 50 generated upon, for example, dispensing the reaction mixture 50 in the chamber 10 and sealing the chamber 10 with the seal 40 can be overcome by spreading the electrical charge via the liquid 30, and a uniform electrical charge density can be created in the biotip 1. This prevents the reaction mixture 50 from adhering to the chamber 10, and stable thermal cycling can be realized in the biotip 1.

The volume resistivity of the liquid 30 should preferably be as small as possible above 0 Ω·cm, because the occurrence of uneven electrical charge in the biotip 1 becomes less likely as the volume resistivity of the liquid 30 becomes smaller. Further, in order to move the reaction mixture 50 in the liquid 30 using a droplet-shuttle thermal cycler (described below), the liquid 30 preferably has a viscosity of $1\times10^4$ $Nsm^{-2}$ or less. The viscosity is preferably $5\times10^3$ $Nsm^{-2}$ or less to move the reaction mixture 50 at a speed suited for a PCR thermal cycle. Examples of the liquid 30 with such properties include dimethylsilicone oils and mineral oils.

The liquid 30 may include a first liquid having a smaller specific gravity than the reaction mixture 50 introduced into the biotip 1, and a second liquid having a smaller specific gravity than the reaction mixture 50 and a smaller volume resistivity than the first liquid.

Because the second liquid has a smaller volume resistivity than the first liquid, the volume resistivity of the liquid 30 can be adjusted by adjusting the mixing proportions of the first liquid and the second liquid. Further, because a liquid having a large volume resistivity can be used as the first liquid, various properties of the liquid 30, including the volume resistivity, viscosity, and stability against heat, can be adjusted to be suited for PCR. For example, the second liquid is mixed with the first liquid when the properties of the first liquid are such that the volume resistivity is too large to be used as the liquid 30 alone but the other properties are more suited for PCR than the second liquid. Because the properties of the liquid 30 can be adjusted according to the mixing ratio of the first liquid and the second liquid, the liquid 30 can have properties suited for PCR, in addition to having a desired volume resistivity.

For example, a silicone oil or a mineral oil may be used as the first liquid. As used herein, "silicone" means a compound whose main backbone is an oligomer or a polymer that includes a siloxane bond. Further, the "silicone oil" as used herein particularly refers to a silicone that is in a liquid state in the temperature range used for thermal cycling. Further, the "mineral oil" as used herein refers to a compound that is purified from petroleum, and is a liquid in the temperature range used for thermal cycling. These oils are suited for droplet-shuttle PCR, because of high heat stability and easy availability, for example, as products with a viscosity of $5\times10^3$ $Nsm^{-2}$ or less.

The silicone oil may be a dimethylsilicone oil, including, for example, KF-96L-0.65cs, KF-96L-1cs, KF-96L-2cs, KF-96L-5cs, (Shin-Etsu Silicone), SH200 C FLUID 5 CS (Dow Corning Toray Co., Ltd.), TSF451-5A, and TSF451-10 (Momentive Performance Materials Inc. Japan, LLC). Examples of the mineral oil include compounds containing alkane of about 14 to 20 carbon atoms as the main component. Specific examples include n-tetradecane, n-pentadecane, n-hexadecane, n-heptadecane, n-octadecane, n-nonadecane, and n-tetracosane.

A modified silicone oil may be used as the second liquid, for example. As used herein, the "modified silicone oil" means a silicone oil with a substituent. Preferably, the second liquid may include, for example, a carbinol group, an alkylsilyl group, a fluoroalkyl group, a silanol group, or an alkylsilsesquioxy group as the substituent. The second liquid may include more than one of these substituents, or may include, for example, an alkylsilyl group and an alkylsilsesquioxy group, or an alkylsilyl group and a fluoroalkyl group. Cyclic siloxane also may be used. Preferably, the second liquid has heat stability in the temperature range of thermal cycling. Specific examples include a carbinol-modified silicone oil, KF-6001 (Shin-Etsu Silicone), BY 16-201, 5562 Calbibol Fluid (Dow Corning Toray Co., Ltd.), and XF42-B0970 (Momentive Performance Materials Inc. Japan, LLC). The carbinol-modified silicone oil has a viscosity of $3\times10^4$ $Nsm^{-2}$ or more. This viscosity is too high for the carbinol-modified silicone oil to be used alone for droplet-shuttle PCR. However, because the carbinol-modified silicone oil has a lower volume resistivity than a dimethylsilicone oil, the conductivity of the liquid 30 can be adjusted by mixing the carbinol-modified silicone oil with a dimethylsilicone oil. Specifically, the volume resistivity becomes smaller as the carbinol-modified silicone oil is added more.

The second liquid may be a liquid containing more than one component, or may be a mixture of a plurality of liquids. For example, the Shin-Etsu Silicone products X21-5250 (50% trimethylsiloxysilicate, 50% cyclopentaloxane), and X21-5616 (60% trimethylsiloxysilicate, 40% isododecane) may be used.

The inlet 20 of the chamber 10 may be sealed with the seal 40. The seal 40 may be formed using the same material used for the chamber 10. The seal 40 may have any of, for example, a screw cap, a plug, and a fitting structure, provided that the chamber 10 can be sealed. In FIG. 1, the seal 40 has a screw cap structure.

1-2. Thermal Cycling Process Using Biotip of First Embodiment

Figure 2:
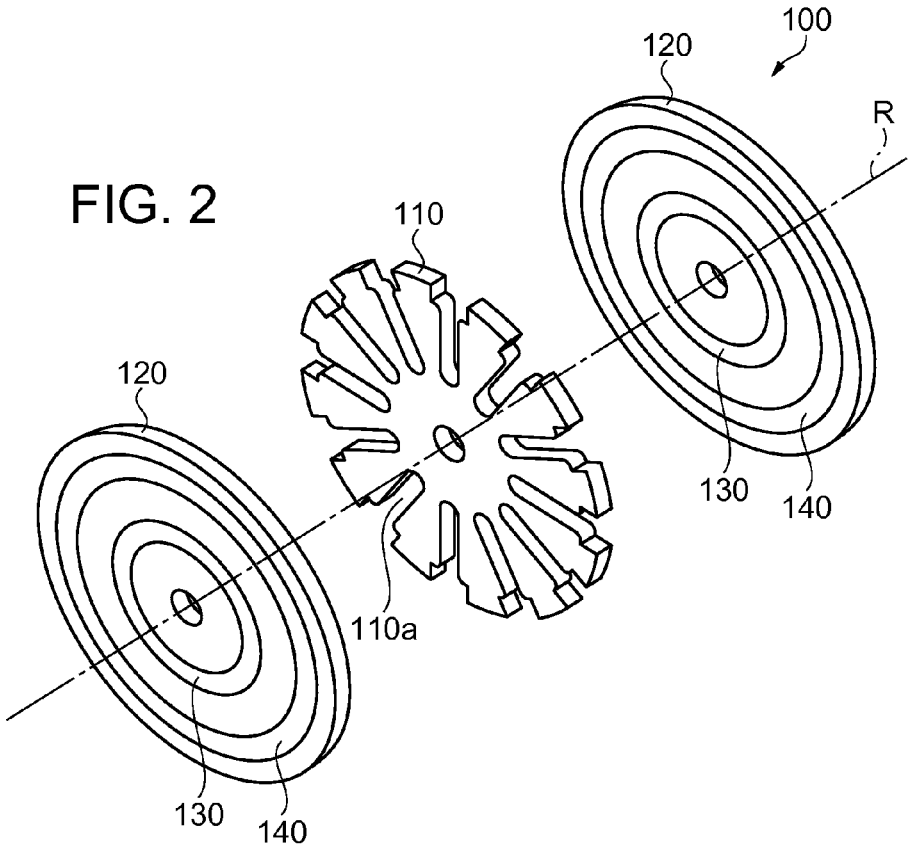
FIG. 2 is an exploded perspective view schematically illustrating a main portion of a thermal cycler according to First Embodiment.
Figure 3:
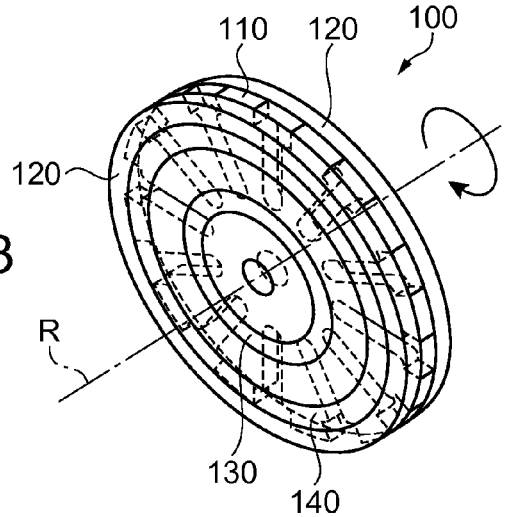
FIG. 3 is a perspective view schematically illustrating a main portion of the thermal cycler according to First Embodiment.

FIG. 2 is an exploded perspective view schematically illustrating a main portion of a thermal cycler 100 of the present embodiment. FIG. 3 is another perspective view schematically illustrating a main portion of the thermal cycler 100 of the present embodiment.

The thermal cycler 100 according to the present embodiment includes a holder 110 provided with holes 110*a* for installing the biotip 1, a pair of rotors 120 that rotate the holder 110 about the axis R (rotation axis; not lying on the gravitational direction) with the biotip 1 installed in the holder 110, and a first heater 130 and a second heater 140 that heat at least apart of the chamber 10 of the biotip 1 installed in the holder 110.

In the example illustrated in FIG. 2, the rotors 120 are cylindrical in shape, and, as illustrated in FIG. 3, are disposed on the both sides of the holder 110 to configure the main portion of the thermal cycler 100. In the state shown in FIG. 3, the rotors 120 rotate about the axis R by being driven with a drive mechanism such as a motor (not illustrated). The holder 110 is structured to include the holes 110*a* where the biotip 1 is installed by being inserted. The holes 110*a* are formed so that their longitudinal direction coincides with the radial direction from the axis R center. With this configuration of the holes 110*a*, the longitudinal direction of the biotip 1 coincides with the radial direction from the axis R center when the biotip 1 filled with the reaction mixture 50 is installed in the holes 110*a*. In this way, the reaction mixture 50 can move along the longitudinal direction of the biotip 1 under the force of gravity by the rotation of the holder 110 installing the biotip 1. As illustrated in FIGS. 2 and 3, all of the biotips 1 can be uniformly subjected to thermal cycling with the plurality of holes 110*a* configured as above. Here, the term "coincide" is used in an extent that the reaction mixture 50 can appropriately move in response to the rotation of the holder 110 installing the biotip 1 filled with the reaction mixture 50. Note that, in order to move the reaction mixture 50 under the gravitational force, the rotation speed of the rotors 120 should preferably be selected so as not to increase too much the centrifugal force that acts on the biotip 1. For example, the rotation speed of the rotors 120 is preferably from 1 rpm (rotation per minute) to 10 rpm.

Further, in the example illustrated in FIG. 2, the first heater 130 is provided in the vicinity of the axis R of the rotors 120, and the second heater 140 in the vicinity of the circumference of the rotors 120. The first heater 130 and the second heater 140 are concentric to the axis R. The first heater 130 and the second heater 140 can be controlled at different temperatures. The temperatures of the first heater 130 and the second heater 140 may be set to temperatures suited for reaction, using, for example, a controller (not illustrated).

For example, when the thermal cycler 100 of the present embodiment is used for two-stage temperature PCR (2-step PCR), the temperatures of the first heater 130 and the second heater 140 are set to 63° C. and 95° C., respectively. In this way, a temperature gradient is formed in which the temperature increases toward the outer side away from areas in the vicinity of the axis R. Thus, activating the thermal cycler 100 with the holder 110 installing the biotip 1 filled with the reaction mixture 50 forms a temperature gradient that includes two temperature regions in the liquid 30 inside the chamber 10: one in the vicinity of the first heater 130 (63° C.), and one in the vicinity of the second heater 140 (95° C.). In this way, the reaction mixture 50 can be subjected to a high-temperature and low-temperature thermal cycle by being moved back and forth by the rotation of the rotors 120.

Figure 4A:
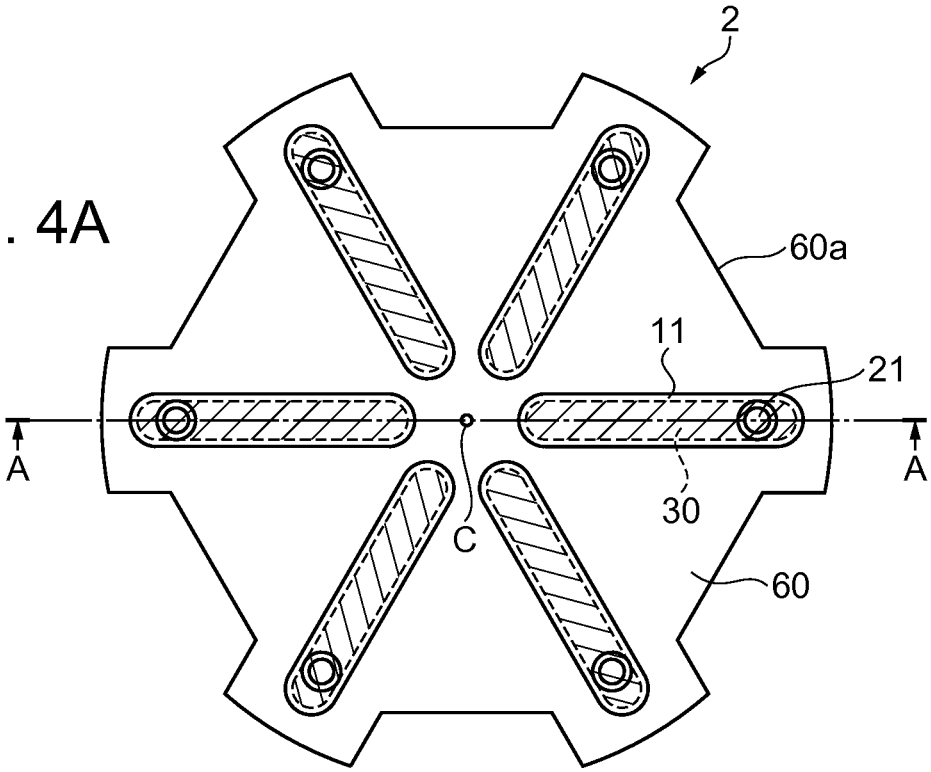
Figure 4B:
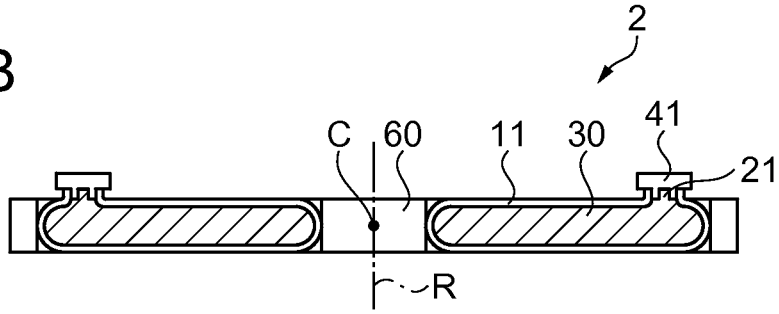

2. Second Embodiment 2-1. Configuration of Biotip According to Second Embodiment FIG. 4A is a plan view schematically illustrating a biotip 2 according to Second Embodiment. FIG. 4B is a schematic plan view of a cross section of the biotip 2 of Second Embodiment taken at line A-A of FIG. 4A. FIGS. 4A and 4B show the state in which the reaction mixture is not introduced into the chamber. The reaction mixture of the present embodiment does not differ from its counterpart in First Embodiment, and is appended with the same reference numeral. Accordingly, the reaction mixture will not be described further.

The biotip 2 according to Second Embodiment is configured to include two or more chambers 11, a seal 41 that seals each chamber 11, and a substrate 60.

In the example illustrated in FIGS. 4A and 4B, a plurality of chambers 11 is held on the disk-shaped substrate 60. The chambers 11 are disposed on the substrate 60 in such a manner than the radial direction from the center at point C at the central portion of the substrate 60 (hereinafter, the center point of the radial direction will be referred to as "center C of the biotip 2" or "center C") coincides with the longitudinal direction of each chamber 11. With the chambers 11 disposed on the substrate 60 in this fashion, rotating the biotip 2 about the rotation axis R (straight line through the center C of the biotip 2, not lying on the gravitational direction) after installing the biotip 2 in the thermal cycler (described later) moves the reaction mixture 50 in each chamber 11 along the longitudinal direction of the chamber 11 under the force of gravity. The chambers 11 disposed on the substrate 60 lie on a single flat plane orthogonal to the axis R. Because the chambers 11 are held on the same flat plane, the reaction mixture 50 in each chamber 11 can move at the same speed under the force of gravity. In this way, all the chambers 11 can be uniformly subjected to thermal cycling. Accordingly, the terms "coincide" and "same" are used in extent that the reaction mixture 50 can appropriately move in response to the rotation of the biotip 2 filled with the reaction mixture 50 and installed in the thermal cycler (described later).

In the example illustrated in FIG. 4A, the substrate 60 is shaped to include cutouts 60*a* along the circumference. The cutouts 60*a* enable the biotip 2 to be fixed in alignment with the thermal cycler when being installed in the thermal cycler (described later). The installation structure may be appropriately designed. For example, a hole, a depression, or a protrusion may be formed in part of the substrate 60, either alone or in combination.

The substrate 60 of the biotip 2 may be integral with the chambers 11, or, as illustrated in FIGS. 4A and 4B, may be made of a different material from the chambers 11 fixed on the substrate 60. In the former case, the substrate 60 may be made of the same material as that used for the chambers 11. In the latter case, the substrate 60 is preferably made of a material that can withstand the heat of PCR, though the material is not particularly limited. When the substrate 60 is made of the same material used for the chambers 11, the material may be mixed with black materials such as carbon black, graphite, titanium black, aniline black, oxides of Ru, Mn, Ni, Cr, Fe, Co, and Cu, and carbides of Si, Ti, Ta, Zr, and Cr. Mixing these black substances with the material of the substrate 60 can suppress the spontaneous fluorescence of resin or other such materials, and thus enables the biotip 2 to be suitably used in applications that involve fluorescence measurements, for example, such as in real-time PCR.

The chambers 11 may be made of the same material used for the chamber 10 of First Embodiment. As illustrated in FIGS. 4A and 4B, the biotip 2 of the present embodiment is structured to include the chambers 11 exposed outside of the substrate 60. With the biotip 2 at least partially exposed on the substrate 60 and the chambers 11 made of the same material used for the chamber 10 of First Embodiment, the same effects obtained with the chamber 10 of First Embodiment also can be obtained. The seal 41 may be made of the same material used for the seal 40 of First Embodiment, and the effects obtained in First Embodiment also can be obtained.

The shape of the chambers 11 of the present embodiment is not particularly limited, and may be the same as the shape of the chamber 10 of First Embodiment. The effects obtained in First Embodiment also can be obtained with the chambers 11. In the example illustrated in FIGS. 4A and 4B, the chambers 11 differ from the chamber 10 of First Embodiment in the position and structure of the inlet 21. By providing the inlet 21 on one of the flat plane sides of the substrate 60 as illustrated in FIGS. 4A and 4B, for example, the reaction mixture 50 can be stably introduced through the inlet 21 with the substrate 60 placed on a table, without using special equipment such as a support.

The chambers 11 are filled with a liquid 30. The liquid 30 is as described in First Embodiment, and can provide the same effects described in First Embodiment.

In the example illustrated in FIGS. 4A and 4B, the seal 41 has a fitting structure. The structure of the seal 41 is not particularly limited, and may be designed to have the same screw structure used for the seal 40 of First Embodiment. In the example illustrated in FIGS. 4A and 4B, the seal 41 is independently provided for each chamber 11. However, for convenience such as operability, more than one seal 41 may be integrally formed to enable the chambers 11 to be sealed at once.

2-2. Thermal Cycling Process Using Biotip of Second Embodiment

Figure 5:
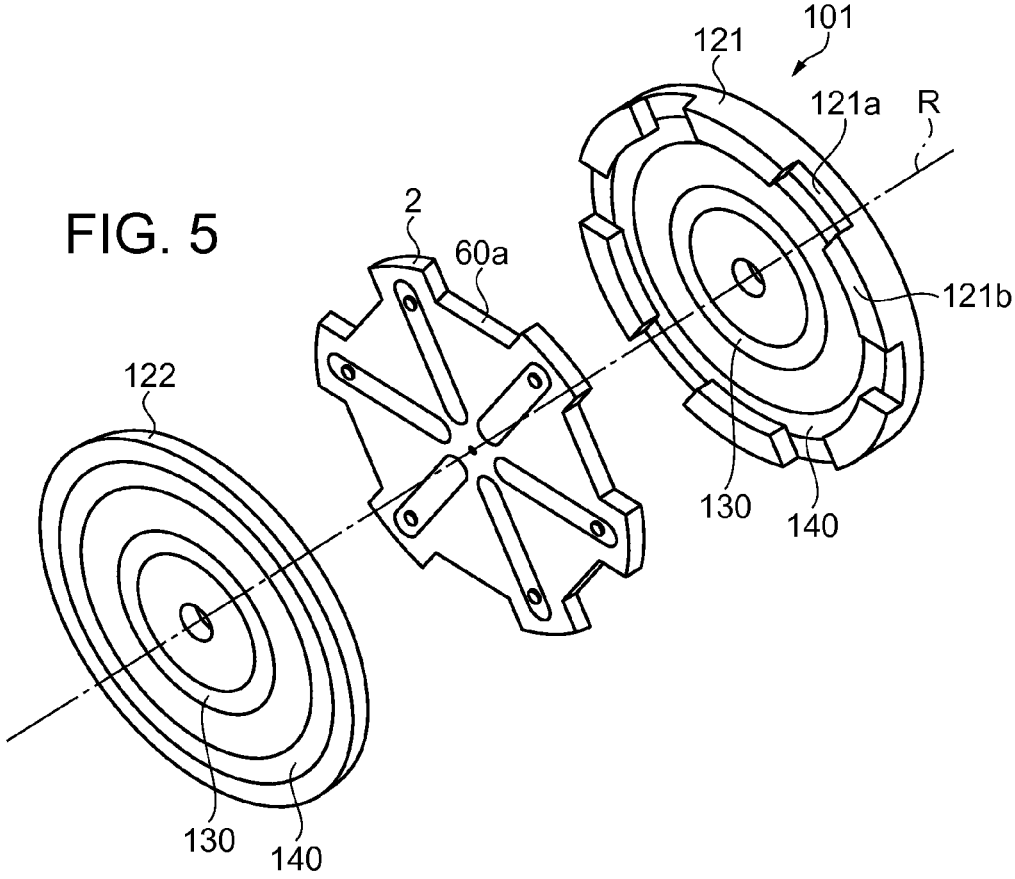
FIG. 5 is a perspective view schematically illustrating a main portion of a thermal cycler according to Second Embodiment.
Figure 6:
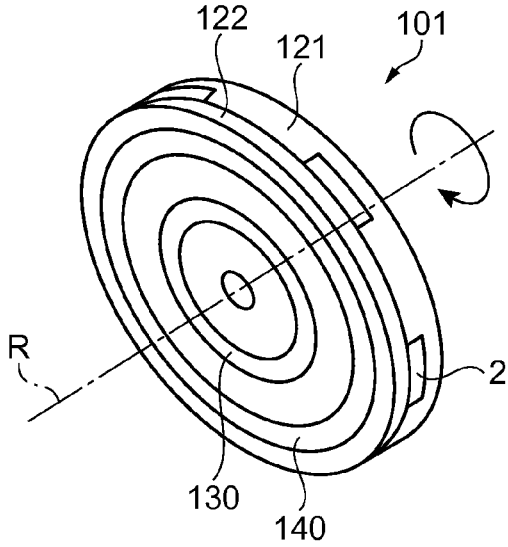
FIG. 6 is a perspective view schematically illustrating a main portion of the thermal cycler according to Second Embodiment.

FIG. 5 is a perspective view schematically representing a main portion of a thermal cycler 101 of the present embodiment. FIG. 6 is another perspective view schematically representing a main portion of the thermal cycler 101 of the present embodiment. The thermal cycler 101 of the present embodiment has the same configuration as the thermal cycler 100 of First Embodiment, except for the structure of the holder 110. Accordingly, the same reference numerals are used for the configuration already described in conjunction with the thermal cycler 100 of First Embodiment, and detailed explanations will not be made for these elements.

In the example illustrated in FIGS. 5 and 6, two rotors 121 and 122 are configured to open and close using a mechanism (not illustrated), and the biotip 2 is held between the rotors 121 and 122. FIG. 5 represents the state in which the rotors 121 and 122 are separated, and FIG. 6 the closed state of the rotors 121 and 122. A holder 111 is formed for the rotor 121 or 122 as a structure corresponding to the shape of the biotip 2. In the present embodiment, the holder 111 is structured as a projection of a part of the rotor 121. The biotip 2 can be installed in the thermal cycler by fitting the cutouts 60*a* of the biotip 2 of the present embodiment with the holder 111 illustrated in FIG. 5. The rotors 121 and 122 may have the same structure, even though the present embodiment described the rotor 121 as including the holder.

It is desirable that the holder 111 be designed to make the center of the biotip 2 coincide with the rotation axis R upon installing the biotip 2. In this way, the center of the biotip 2 becomes the rotational center, and thus the reaction mixture 50 can move along the longitudinal direction of the chamber 11 under the gravitational force in all of the chambers 11 upon rotating the rotors 121 and 122 with the biotip 2 installed in the holder 111 with the reaction mixture 50 and held on the rotor 121 as illustrated in FIG. 6. Specifically, all of the chambers 11 of the biotip 2 can be uniformly subjected to thermal cycling as with the case of using a plurality of biotips each including a single chamber. Thus, the term "coincide" here is used in an extent that the reaction mixture 50 can appropriately move in response to the rotation of the biotip 2 filled with the reaction mixture 50 and installed in the thermal cycler. The movement of the reaction mixture 50 in each chamber 11 is as described in First Embodiment.

3. EXAMPLE

The invention is described in more detail based on Example. Note, however, that the invention is not limited to the Example below. Even though the following Example is described based on the biotip 1 of First Embodiment, the biotip 2 of Second Embodiment is also applicable to the following Example.

The behavior of the reaction mixture was examined by experimentation using different second liquids at varying mixing proportions (addition amounts). As the first liquid, high-purity dimethylsilicone oil was used. The types of the second liquid used, and the mixing proportions are presented in Table 1 below. The proportion of the second liquid is the percentage of the second liquid with respect to the 100% volume of the liquid 30 as the mixture of the first liquid and the second liquid. The first liquid and the second liquid were filled in the biotip 1, and the biotip 1 was sealed with the seal 40 after dispensing the reaction mixture. The biotip 1 had an inner diameter D of 2 mm, and a length L of 20 mm. The reaction mixture was 0.5 μl. The high-purity dimethylsilicone oil is an insulant, but has high stability against heat and the reaction mixture. KF-96L-0.65cs (a carbinol-modified silicone oil) was added in 1% to 5% at 1% intervals. In the experiment, XS66-B8226 and XS66-C1191 (trifluoroalkyldimethyltrimethylsiloxysilicate), X21-5250 (50% trimethylsiloxysilicate, 50% cyclopentasiloxane), and SilForm Flexible Resin (polymethylsilsesquioxane) were added in 4%, 1%, 0.5%, 0.1%, 0.05%, 0.01%, and 0.005%. Ten chambers 10 were prepared for each condition, and the behavior of the reaction mixture was observed by rotating the biotip 1 in each different condition with the thermal cycler at a predetermined temperature. The reaction mixture was determined as "non-adherent" when it did not adhere to the chamber 10 and moved from one end to the opposite end in 2 seconds or less, and "adherent" when the reaction mixture adhered to the chamber 10 and/or took longer than 2 seconds to move. The following notation is used in the table. Good: no adhesion in 5 or more chambers out of the 10 chambers; Poor: adhesion in 6 or more chambers. In the table, the five oils except for the carbinol-modified silicone oil are presented only with data that brought a change in the adhesion state, specifically the minimum addition amounts that produced the "Good" result, and the maximum addition amounts that produced the "Poor" result. Note that it was confirmed that second liquid amounts greater than the amounts shown in the table moved the reaction mixture, and second liquid amounts smaller than the amounts shown in the table caused the reaction mixture to adhere.

The volume resistivity of the liquid 30 was measured at the minimum amounts that produced the "Good" result, and at the maximum amounts that produced the "Poor" result. Measurements were made at a voltage of 10 V, using a Universal Electrometer MMA-II-17B (Kawaguchi Electric Works). The maximum volume resistivity value, measured as $4.8\times 10^{13}$ Ω·cm, occurred with 4% carbinol-modified silicone oil among the conditions that produced the "Good" result.

TABLE 1

| No. | Product name | Manufacturer | Component | Addition amount (%) | Movement of reaction liquid | Volume resistivity (Ω · cm) |
|---|---|---|---|---|---|---|
| 1 | X-22-160AS | Shin-Etsu Silicone | Carbinol-modified silicone oil | 5 | Good | 4.8 × E13 |
| | | | | 4 | Good | 4.0 × E13 |
| | | | | 3 | Poor | — |
| | | | | 2 | Poor | — |
| | | | | 1 | Poor | — |
| 2 | XS66-B8226 | Momentive Performance Materials | Trifluoroalkyldimethyl-trimethylsiloxysilicate | 4 | Good | 5.4 × E10 |
| | | | | 0.005 | Good | 9.0 × E12 |
| 3 | XS66-C1191 | Momentive Performance Materials | Trifluoroalkyldimethyl-trimethylsiloxysilicate | 4 | Good | 7.8 × E10 |
| | | | | 0.005 | Good | 1.1 × E12 |
| 4 | X21-5250 | Shin-Etsu Silicone | 50% Trimethylsiloxysilicate, 50% cyclopentasiloxane | 4 | Good | 3.6 × E11 |
| | | | | 0.5 | Good | 8.0 × E12 |
| | | | | 0.1 | Poor | — |
| 5 | SilForm Flexible resin | Momentive Performance Materials | Polymethylsilsesquioxane | 4 | Good | — |
| | | | | 1 | Good | 9.0 × E12 |
| | | | | 0.5 | Poor | — |

E under the column Volume resistivity means the power of the base number 10 (e.g., 1 × E3 = 1 × 103).

4. Variation

Figure 7:
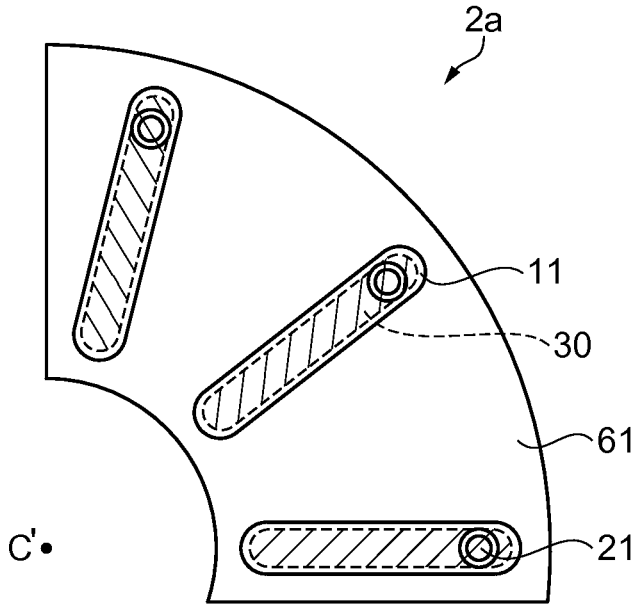
FIG. 7 is a plan view schematically illustrating a biotip according to Variation.

FIG. 7 is a plan view schematically illustrating a biotip 2*a* according to Variation. The biotip 2*a* of this variation has the same configuration of the biotip 2 of Second Embodiment except for the shape of the substrate and the position of the biotip center. Accordingly, the same reference numerals are used for the configuration already described in conjunction with the biotip 2 of Second Embodiment, and detailed explanations will not be made for these elements.

In the example illustrated in FIG. 7, the biotip 2*a* includes a substrate 61 that has a partial annular shape as viewed in a direction perpendicular to the flat plane that holds the chambers 11 (the shape cut out from the region surrounded by two concentric circles of different radii along two radial lines of the larger of the two concentric circles; about ¼ of the circular ring in FIG. 7). The center C' of the arc of the biotip 2*a* is the center point of the arc forming the substrate 61, and, in FIG. 7, represents the center point of the circular ring. Specifically, the center C' does not necessarily coincide with the point at the central portion of the substrate 61. The chambers 11 are disposed on the substrate 61 in such a manner that the radial direction from the center C' coincides with the longitudinal direction of the chambers 11. In this way, the axis R can coincide with the center C' when the biotip 2*a* is rotated after being installed in the thermal cycler (described later) 101*a*, even when the shape of the biotip 2*a* is asymmetrical about the point at the central portion of the substrate 61. The effects obtained with the biotip 2 of Second Embodiment also can be obtained in this manner.

Further, because the center C' of the biotip 2*a* specifying the layout of the chambers 11 may be a point outside of the substrate 61, the substrate 61 can have various shapes. The shape of the substrate 61 may be appropriately selected taking into account factors such as the number of the chambers 11, and ease of handling. For example, the shape as viewed from a direction perpendicular to the flat plane holding the chambers 11 may be fan-shaped or rectangular.

Figure 8:
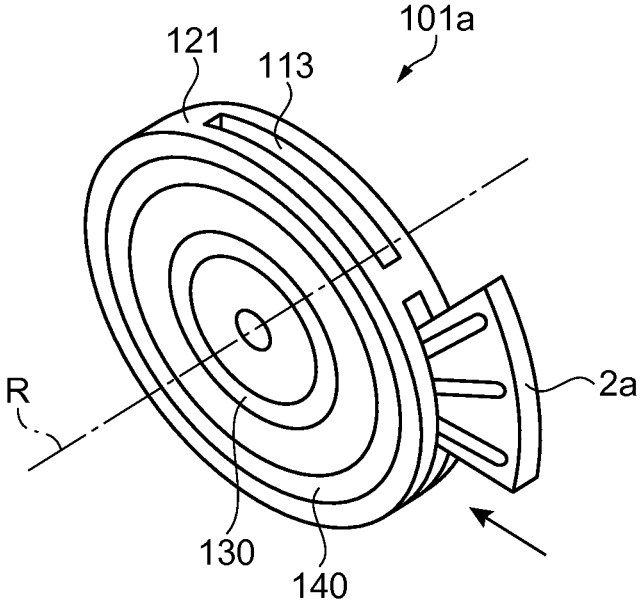
FIG. 8 is a perspective view schematically illustrating a main portion of a thermal cycler according to Variation.

FIG. 8 is a perspective view schematically representing a main portion of the thermal cycler 101*a* according to Variation. The thermal cycler 101*a* has the same configuration as the thermal cycler 101 of Second Embodiment except for the holder structure. Accordingly, the same reference numerals are used for the configuration already described in conjunction with the thermal cycler 101 of Second Embodiment, and detailed explanations will not be made for these elements.

In the example illustrated in FIG. 8, the rotor 121 has slots 113 that correspond to the shape of the biotip 2*a*. In the thermal cycler 101*a*, the slots 113 correspond to the holder. The biotip 2*a* can be installed by being inserted to one of the slots 113. Preferably, the slots 113 are sized and shaped to enable the biotip to be fixed upon being installed. A fixing member (not illustrated) may be provided for this purpose.

It is desirable that a holder 112 be formed in such a manner that the center C' of the biotip 2*a* coincides with the rotation axis R upon installing the biotip 2*a*. The effects obtained with the thermal cycler 101 of Second Embodiment also can be obtained in this manner with the biotip 2*a* of this variation. Here, the term "coincide" is used as defined in Second Embodiment.

The invention is not restricted by the foregoing embodiments, and may be modified in various ways. For example, the invention encompasses configurations essentially the same as those described in the embodiments (for example, configurations with the same functions, methods, and results, and configurations with the same objects and effects). Further, the invention also encompasses configurations that have replaced the non-essential parts of the configurations described in the embodiments. Further, the invention also encompasses configurations that have the same advantages as the configurations of the foregoing embodiments, and configurations that can achieve the same object as that of the embodiments. The invention also encompasses configurations that add a known technique to the configurations described in the embodiments.

What is claimed is:

1. A biotip that allows a reaction mixture to move along a longitudinal direction of an elongated chamber under the force of gravity, the biotip comprising:

the elongated chamber formed of a transparent material;

a pre-filled liquid that is filled in the elongated chamber, the pre-filled liquid having a different specific gravity from that of the reaction mixture and immiscible with the reaction mixture; and a seal that seals the chamber, wherein the pre-filled liquid has a volume resistivity that is greater than 0 Ω·cm and that is equal to or less than $5\times10^{13}$Ω·cm, the pre-filled liquid includes:

a first liquid that has a different specific gravity from that of the reaction mixture; and a second liquid that has a different specific gravity from that of the reaction mixture and that has a smaller volume resistivity than the first liquid, and wherein the first liquid is non-modified silicone and the second liquid is modified silicone.

2. A biotip that allows a reaction mixture to move along a longitudinal direction of each of two or more elongated chambers, which are in a tube shape, under the force of gravity, the biotip comprising:

each of the elongated chambers formed of a transparent material;

a pre-filled liquid that is filled in each of the elongated chambers, the pre-filled liquid having a different specific gravity from that of the reaction mixture and immiscible with the reaction mixture;

two or more seals, each of the seals sealing each of the elongated chambers; and a substrate that holds the elonqated chambers within a single flat plane, the elongated chambers are spaced apart from each other in the substrate, wherein the pre-filled liquid has a volume resistivity that is greater than 0 Ω·cm and that is equal to or less than $5\times10^{13}$ Ω·cm, each of the elongated chambers is aligned along a radial direction from a center of the single flat plane of the substrate, and the pre-filled liquid includes:

a first liquid that has a different specific gravity from that of the reaction mixture; and a second liquid that has a different specific gravity from that of the reaction mixture and that has a smaller volume resistivity than the first liquid, wherein the first liquid is non-modified silicone and the second liquid is modified silicone.

3. The biotip according to claim 1, wherein a viscosity of the pre-filled liquid is $1\times10^{4}$ $Nsm^{-2}$ or less.

4. The biotip according to claim 1, wherein a viscosity of the first liquid is $5\times10^{3}$ $Nsm^{-2}$ or less.

5. The biotip according to claim 4, wherein a viscosity of the second liquid is $3\times10^{4}$ $Nsm^{-2}$ or more.

* * * * *